US009253564B2

(12) United States Patent
Prentice

(10) Patent No.: US 9,253,564 B2
(45) Date of Patent: Feb. 2, 2016

(54) NOISE-CANCELING HEADPHONE DEPLETION-MODE SWITCH

(71) Applicant: Fairchild Semiconductor Corporation, San Jose, CA (US)

(72) Inventor: Seth M. Prentice, Auburn, ME (US)

(73) Assignee: FAIRCHILD SEMICONDUCTOR CORPORATION, San Jose, CA (US)

( * ) Notice: Subject to any disclaimer, the term of this patent is extended or adjusted under 35 U.S.C. 154(b) by 244 days.

(21) Appl. No.: 13/920,929

(22) Filed: Jun. 18, 2013

(65) Prior Publication Data

US 2013/0336506 A1 Dec. 19, 2013

Related U.S. Application Data

(60) Provisional application No. 61/661,314, filed on Jun. 18, 2012.

(51) Int. Cl.

| | |
|---|---|
| ***G10K 11/16*** | (2006.01) |
| ***H04R 3/00*** | (2006.01) |
| ***H04R 5/04*** | (2006.01) |
| *H04R 1/10* | (2006.01) |
| *H04R 5/033* | (2006.01) |

(52) U.S. Cl.

CPC .. *H04R 3/00* (2013.01); *H04R 5/04* (2013.01); *H04R 1/1041* (2013.01); *H04R 5/033* (2013.01); *H04R 2460/01* (2013.01); *H04R 2460/03* (2013.01)

(58) Field of Classification Search

CPC . H01L 29/1066; H01L 29/8083; H03F 1/305; H01B 3/427; H01B 3/441; H01B 3/30; H01B 3/442; H02H 3/087; H02H 9/045; H03M 1/682; H03M 1/765; H04W 52/0209; H05B 33/0815; H05B 33/0827; H05B 33/0845

USPC ..... 381/1, 13, 309, 71.1–71.6, 123, 92, 77, 381/74, 94.1–94.7

See application file for complete search history.

(56) References Cited

U.S. PATENT DOCUMENTS

| | | | | |
|---|---|---|---|---|
| 5,703,529 | A * | 12/1997 | Ghaffaripour | H03F 1/305 330/110 |
| 8,019,096 | B2 * | 9/2011 | Sander | H04R 1/1041 381/122 |
| 8,254,592 | B2 | 8/2012 | Sander et al. | |
| 8,285,208 | B2 | 10/2012 | Terlizzi | |
| 2011/0286612 | A1 * | 11/2011 | Cooper | H04H 60/04 381/123 |

(Continued)

FOREIGN PATENT DOCUMENTS

| | | | |
|---|---|---|---|
| CN | 101425048 | A | 5/2009 |
| CN | 103517184 | A | 1/2014 |

(Continued)

*Primary Examiner* — Lun-See Lao

(74) *Attorney, Agent, or Firm* — Schwegman Lundberg & Woessner, P.A.

(57) ABSTRACT

This document discusses, among other things, systems and methods including a depletion-mode switch configured to pass an audio signal from an input to an output in a low-impedance state when a power source is below a threshold and to isolate the input from the output in a high-impedance state when the power source is above the threshold and a noise-cancelation circuit configured to receive the audio signal from the input and to provide a modulated audio signal at the output when the power source is above the threshold.

20 Claims, 5 Drawing Sheets

(56) References Cited

U.S. PATENT DOCUMENTS

2012/0121106 A1* 5/2012 Henriksen ..... H03F 1/3211 381/94.1
2012/0163614 A1* 6/2012 Asada ..... G10K 11/1786 381/71.1
2013/0035040 A1 2/2013 Terlizzi
2013/0329916 A1* 12/2013 Breece, III ..... H04R 1/1041 381/122

FOREIGN PATENT DOCUMENTS

CN 203435132 U 2/2014
KR 101374074 B1 3/2014

* cited by examiner

NOISE-CANCELING HEADPHONE DEPLETION-MODE SWITCH

CLAIM OF PRIORITY

This application claims the benefit of priority under 35 U.S.C. §119(e) of Seth M. Prentice et al. U.S. Provisional Patent Application Ser. No. 61/661,314, titled "DEPLETION MODE FIELD EFFECT TRANSISTOR APPLICATIONS," filed on Jun. 18, 2012, which is incorporated by reference herein in its entirety.

BACKGROUND

In typical active noise-canceling systems including noise-canceling circuitry powered by a battery, when the battery has a low charge, the audio output can become distorted or absent. The existing art addresses this problem in several ways.

To avoid the distortion from the noise-canceling circuitry, a user can either provide more power, such as by removing and replacing or otherwise changing the battery or plugging the active noise-canceling system into another power supply. Other systems include a switch coupled to the noise-cancelation circuitry that the user can physically toggle to divert the audio path around the noise-canceling circuitry. One existing solution requires the user to disconnect the battery from the noise-canceling circuitry. However, each of these solutions requires physical interaction from a user and can interrupt audio output or other interaction between a headset and the user.

In another example, a wireless headset can include a digital signal processor configured to monitor battery conditions and ambient noise levels and to turn off part of or all noise-canceling circuitry in the wireless headset in response to low levels of detected ambient noise or in response to low battery conditions. However, this solution requires that a wireless headset include a digital signal processor for implementation, and, as such, when the battery level drops below a required threshold for operation of the digital signal processor, this solution fails, as the wireless headset can no longer communicates with any other electronic device.

OVERVIEW

This document discusses, among other things, systems and methods including a depletion-mode switch configured to pass an audio signal from an input to an output in a low-impedance state when a power source is below a threshold and to isolate the input from the output in a high-impedance state when the power source is above the threshold and a noise-cancelation circuit configured to receive the audio signal from the input and to provide a modulated audio signal at the output when the power source is above the threshold.

This overview is intended to provide an overview of subject matter of the present patent application. It is not intended to provide an exclusive or exhaustive explanation of the invention. The detailed description is included to provide further information about the present patent application.

BRIEF DESCRIPTION OF THE DRAWINGS

In the drawings, which are not necessarily drawn to scale, like numerals may describe similar components in different views. Like numerals having different letter suffixes may represent different instances of similar components. The drawings illustrate generally, by way of example, but not by way of limitation, various embodiments discussed in the present document.

DETAILED DESCRIPTION

Figure 1:
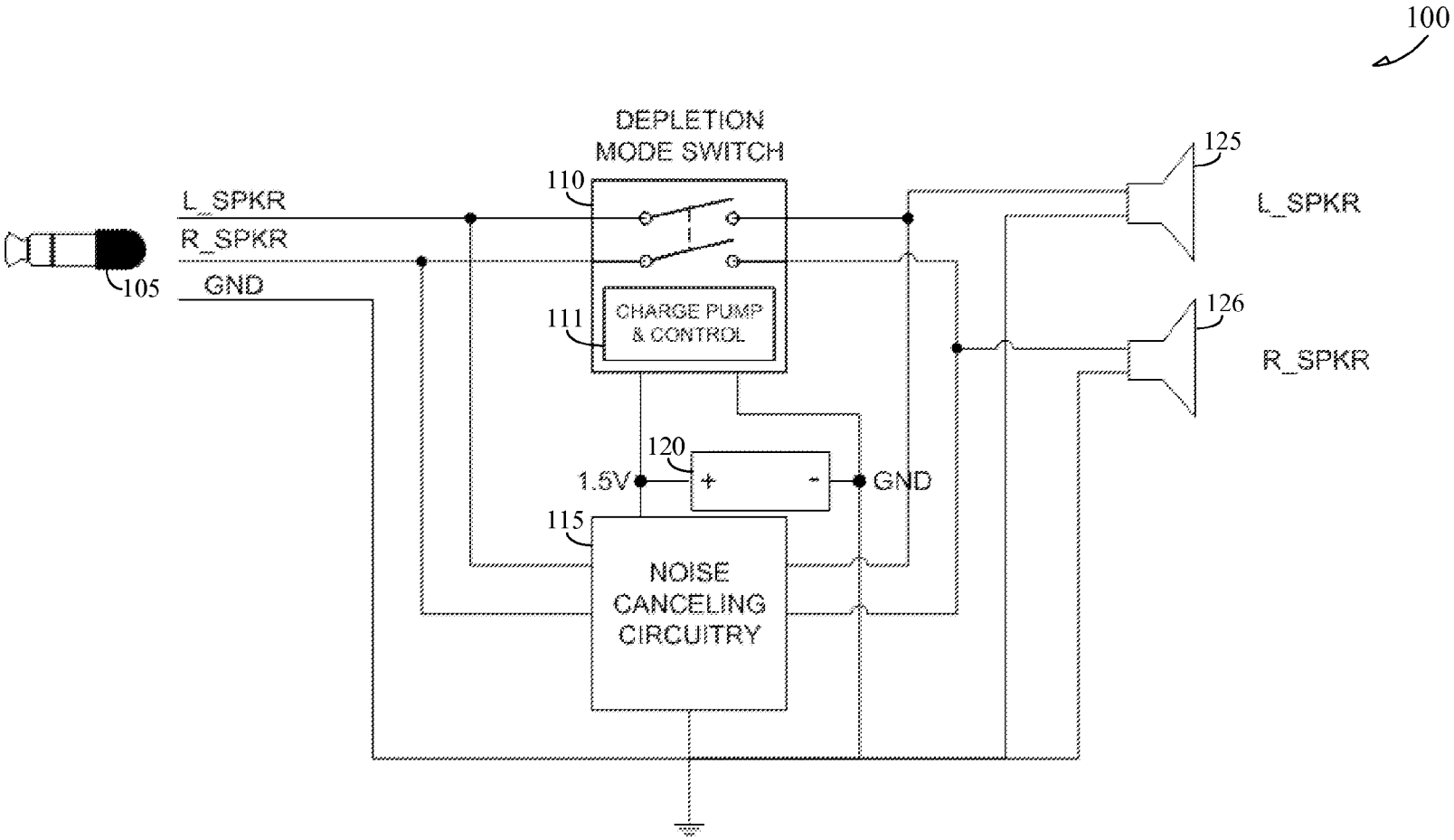
FIG. 1 illustrates generally an example noise-canceling system powered by a battery and including noise-canceling circuitry in parallel with a depletion-mode switch.

The present inventors have recognized, among other things, systems and methods configured to transition a received audio signal in headset applications around noise-canceling circuitry under low-battery or no-power conditions without requiring user interaction, for example, using a depletion-mode switch. In an example, the systems and methods disclosed herein can be configured for use with wired headsets having noise-canceling circuitry.

A field-effect transistor (FET) can include a transistor having a gate region separated from a semiconductor region by an insulator. The semiconductor region generally includes a substrate of a first conductivity type and a source region and drain region of a second different conductivity type located on either side of the semiconductor region, proximate the insulator.

In an example, FET devices can include "n-channel" or "p-channel" devices. The "n-channel" and "p-channel" refer to the type of charge carrier providing conduction between the source region and the drain region. An "n-channel" or "NMOS" device uses majority conduction using electrons when the device is biased into conduction.

Similarly, a "p-channel" or "PMOS" device refers to majority conduction using the migration of "holes."

FET devices can be categorized, generally, as enhancement-mode (e.g., "normally-ON") or depletion-mode (e.g., "normally-OFF") devices. An enhancement-mode FET includes a transistor having a drain region and a source region isolated by the substrate. In the enhancement FET, as voltage is applied to the gate, a channel can form in the semiconductor region between the source and the drain, allowing current to flow between the source and the drain.

In contrast to the enhancement FET, a depletion FET includes a transistor having a coupled source and drain region extending below the gate. Here, as voltage is applied to the gate, a depletion region forms in the semiconductor region proximate the insulator, narrowing the coupled region between the source and the drain, reducing the ability for current to flow between the source and the drain.

Typically, when used as switching devices, FETs have two states: a low-impedance state (e.g., "ON state") configured to pass a signal from a first node (e.g., input) to a second node (e.g., output); and a high-impedance state (e.g., "OFF state") configured to isolate the first node from the second node. Switching devices can have different operating characteristics between the high- and low-impedance states, depending, upon other things, an applied gate voltage.

For example, to be placed in a low-impedance state, a typical enhancement-mode n-channel FET can require a positive gate voltage (e.g., above a specified threshold depending on, upon other things, the specific FET and the signal being passed from the first node to the second node). Without a positive gate voltage, such as under no-power conditions, the typical enhancement-mode n-channel switch will remain in a high-impedance state. Accordingly, enhancement-mode switches typically require that a positive or negative gate voltage be applied to place the switches in a low-impedance state. Under low- or no-power conditions, enhancement-mode switches are typically in a high-impedance state. In contrast, under low- or no-power conditions, depletion-mode switches are typically in a low-impedance state, and instead require a positive or negative gate voltage be applied to place the switches in a high-impedance state.

The present inventors have recognized, among other things, that one or more depletion-mode devices can be used to provide a default signal path under various low- or no-power conditions, for example, to bypass noise-cancelation circuitry in wired-headphone applications. In an example, wireless headphones require power to receive and provide an audio signal to a user. However, the systems and methods described herein can be used to extend battery life in wireless applications by diverting an audio signal around noise-cancelation circuitry under low-power (e.g., low-battery) conditions.

FIG. 1 illustrates generally an example noise-canceling system 100 powered by a battery 120 and including noise-canceling circuitry 115 in parallel with a depletion-mode switch 110 including a charge pump and control circuitry 111. The example of FIG. 1 further includes an audio jack plug 105 and left and right speakers (L_SPKR, R_SPKR) 125, 126.

In an example, the depletion mode switch 110 can include first and second p-channel depletion-mode transistors. In an example, when the voltage of the battery 120 is above a threshold, the charge pump and control circuitry 111 can provide a negative gate voltage to the first and second p-channel depletion-mode transistors, keeping the depletion-mode switch 110 in a high-impedance state. In an example, when the battery 120 is less than a threshold, such as when the battery 120 is low on charge (e.g., less than 1.5 volts (V), less than 1V, or one or more other voltage levels depending on the battery type, amount of batteries, requirements of the noise-canceling circuitry, etc.), the depletion-mode switch 110 can route received audio signals (e.g., a left speaker audio signal (L_SPKR), a right speaker audio signal (R_SPKR), etc.) around the noise-canceling circuitry 115, for example, without user interaction. In an example, the threshold can be at or above the voltage at which the output of the noise-canceling circuitry begins to become distorted or absent, or a minimum operating voltage of the noise-canceling circuitry.

In an example, when the voltage of the battery 120 is below a threshold, the noise-canceling circuitry 115 can be disabled, such that, in low- or no-power conditions, a headset including the noise-canceling circuitry 115 can operate, without user interaction, as if no noise-canceling circuitry 115 is included.

The depletion-mode switch 110 disclosed herein can be configured to provide a seamless transition around the noise-canceling circuitry when the battery is low on charge, can provide a better user experience (e.g., audio output without actuating switching or removing batteries, etc.), and can provide better audio fidelity when compared to the typical active noise-canceling systems.

MIC/GND Audio Jack X-Point with Depletion-mode GND Switch

In typical audio jack detection systems without a mechanical switch, if an audio plug is inserted into an audio jack and a ground connection is not present in the audio jack detection system, an error detection can occur. Accordingly, typical audio jack detection systems require a ground connection at all times. However, the ground connection increases the current draw of the audio jack detection system when no plug is connected. The present inventors have recognized, among other things, that one or more depletion-mode switches can be used to remove the ground connection in an audio jack detection system.

Figure 2:
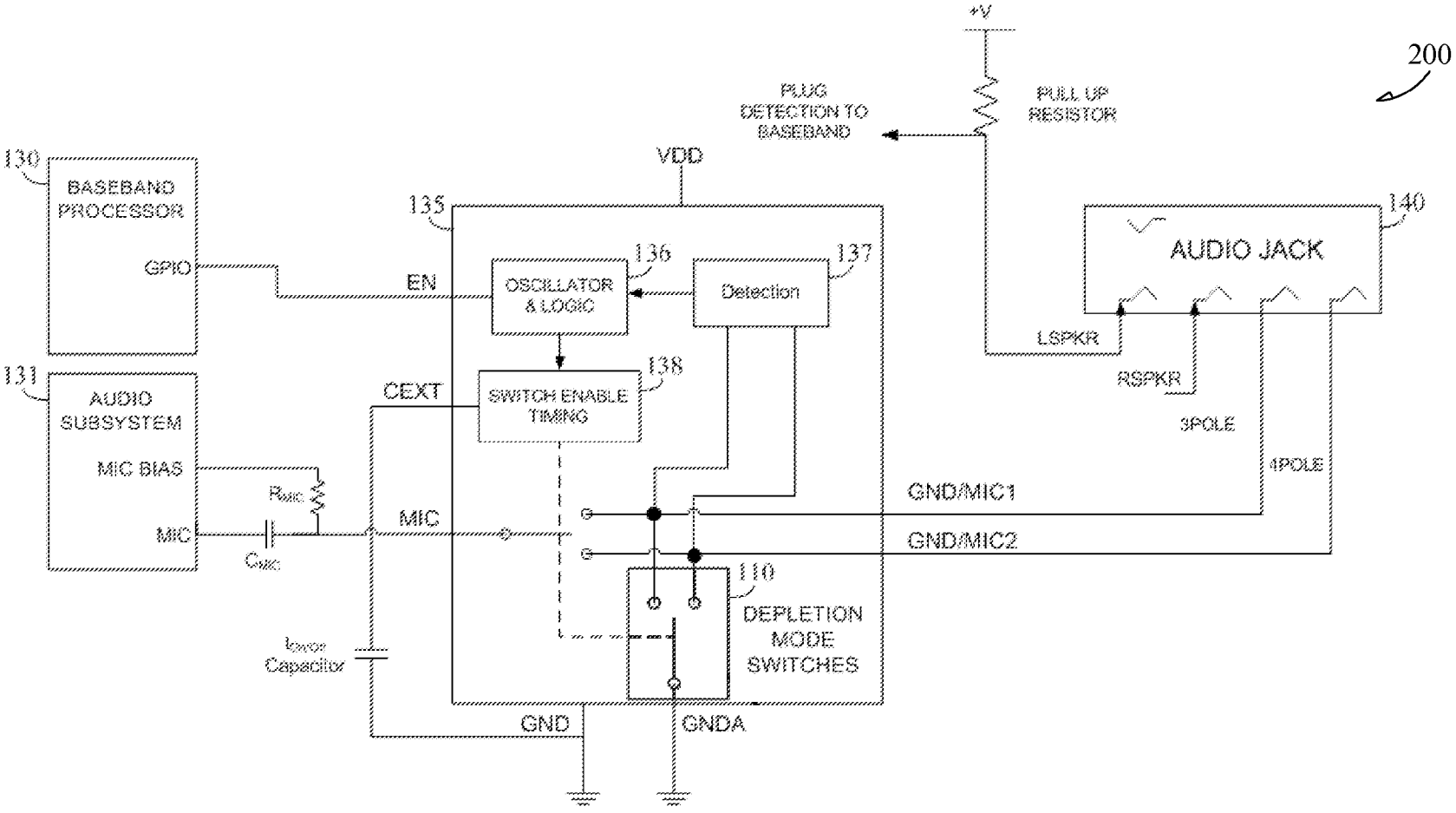
FIG. 2 illustrates generally an example audio jack detection system including a depletion-mode switch configured to provide a ground connection to the third or fourth poles of the audio jack.

FIG. 2 illustrates generally an example audio jack detection system 200 including a depletion-mode switch 110 configured to provide a ground connection to a third or fourth pole of an audio jack 140. The system 200 can include a baseband processor 130 and an audio subsystem 131 coupled to an audio jack detection circuit 135 including an oscillator and logic 136, a ground/mic pin detection circuit 137, a switch enable and timing circuit 138, and the depletion mode switch 110.

In an example, when at least a portion of the audio jack detection system 200 is off or disabled, a ground connection can be connected using the depletion mode switch 110, addressing the plug detect issue with low or no power. The depletion-mode switch 110 can be configured to provide a low-power solution to remove the ground connection to the audio jack detection system 200 and, in certain examples, can be used to detect an audio jack plug without power.

USB Switch with Depletion-mode Switches

Many mobile electronic devices, such as mobile phones, etc., use a USB path for factory testing. However, this can require a power source to activate a switch and route test signals to the correct device in the mobile electronic device.

Further, many mobile electronic devices use the USB connector for multiple signal types, multiple uses, or to send or receive multiple types of information. Typically, a switch is used to provide the desired connection between the mobile electronic device and the USB connector. However, power is typically required for this switch even when the default USB path is used.

The present inventors have recognized, among other things, that one or more depletion mode switches can be used to provide default switch connections in electronic devices without power.

Figure 3:
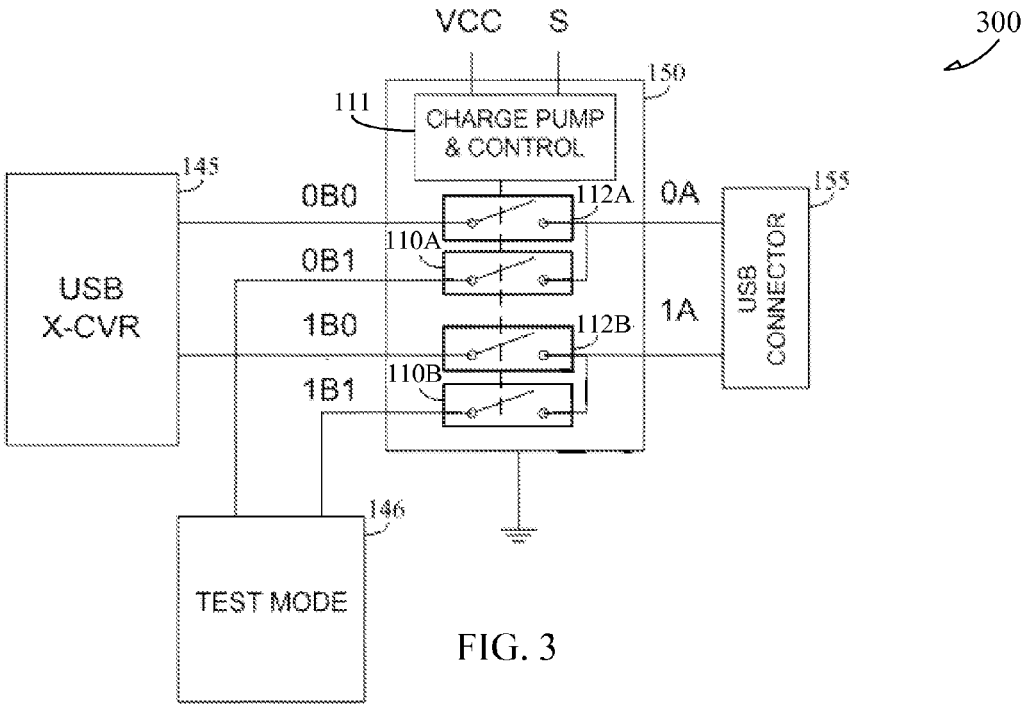
FIGS. 3-4 illustrate generally example USB switches including first and second default switches and first and second secondary switches.
Figure 4:
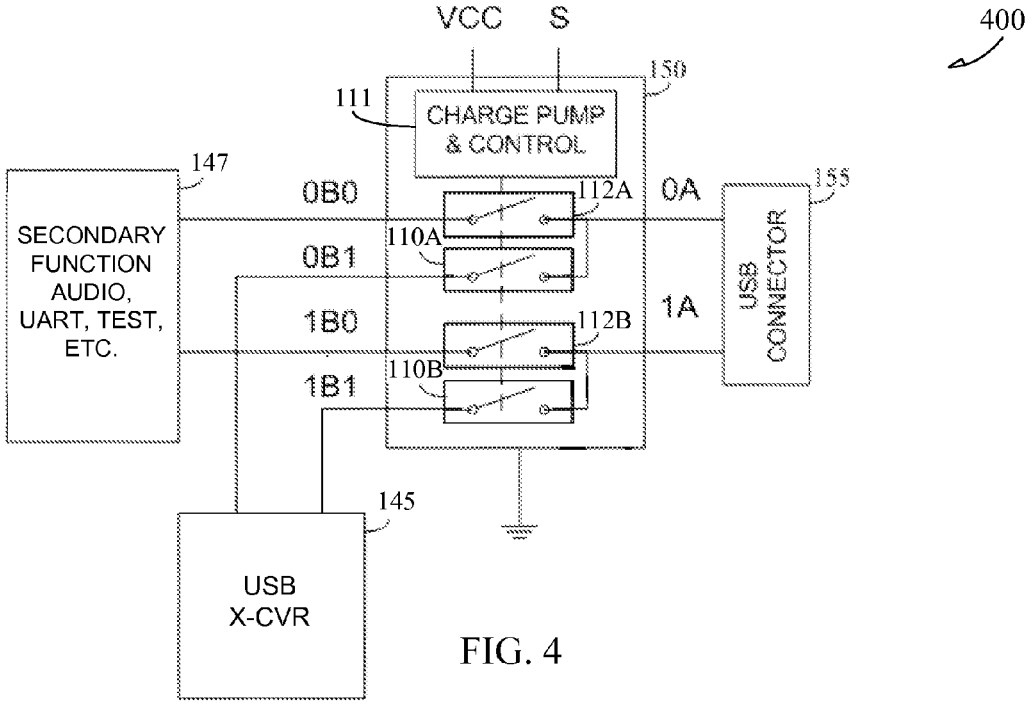

FIGS. 3-4 illustrate generally example USB switch systems 300, 400 including a USB switch 150, first and second default switches 110A, 110B, and first and second secondary switches 112A, 112B. The USB switch systems 300, 400 can further include a USB connector 155, a USB transceiver (USB X-CVR) 145, and a test mode module 146 in FIG. 3 or a secondary function module 147, such as an audio module, a universal asynchronous receiver/transmitter (UART), a test module, or one or more other secondary function modules, in FIG. 4.

In an example, the first and second default switches 110A, 110B can include depletion-mode switches and can be used to provide connection for the default path when the USB switch systems 300, 400 are without power. The USB switch 150 can include a charge pump and control circuitry 111 configured to provide a gate signal to the depletion-mode switches when sufficient power is applied to the USB switch 150. The first and second secondary switches 112A, 112B can include typical enhancement-mode switches, such as complimentary metal-oxide-semiconductor (CMOS) switches, and when power to the respective USB switch 300, 400 is ramped up, the first and second secondary switches 112A, 112B can be controlled.

In an example, using the depletion-mode switches for the default path can reduce system power by connecting the default path without powering the respective USB switch 300, 400 and can further provide connection in a test mode without requiring power to the mobile electronic device.

Audio Switch with Depletion-mode Switches

Many mobile electronic devices, such as mobile phones, use an audio path to send or receive secondary signals other than audio signals. However, using the audio path to send or receive the secondary signals typically requires a power source to route both the default audio path and the secondary signal to the correct device in the mobile electronic device, which can consume excess power.

Figure 5:
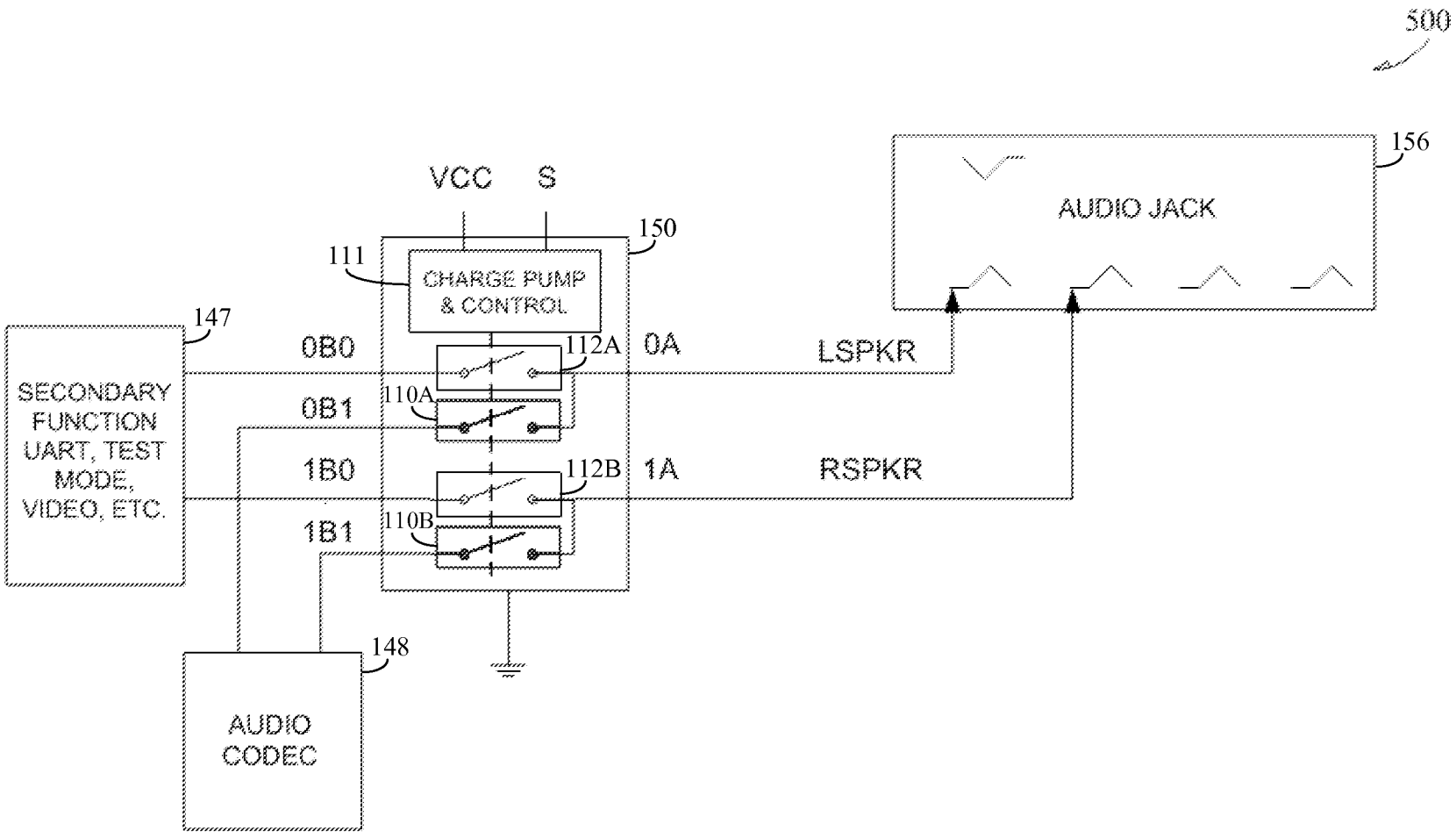
FIG. 5 illustrates generally an example audio switch including first and second default switches and first and second secondary switches.

FIG. 5 illustrates generally an example audio switch system 500 including an audio switch 150, first and second default switches 110A, 110B, and first and second secondary switches 112A, 112B. The audio switch system 500 can further include a secondary function module 147, such as a universal asynchronous receiver/transmitter (UART), a test mode module, a video module, or one or more other secondary function modules, an audio codec 148, and an audio jack receptacle 156.

In an example, the first and second default switches 110A, 110B can include depletion-mode switches configured to provide a connection for the default path (e.g., a default audio path, etc.) when the audio switch 500 is without power. The audio switch 150 can include a charge pump and control circuitry 111 configured to provide a gate signal to the depletion-mode switches when sufficient power is applied to the audio switch 150. The first and second secondary switches 112A, 112B can include typical enhancement-mode switches, such as complimentary metal-oxide-semiconductor (CMOS) switches, and when power to the respective audio switch 500 is ramped up, the secondary switches can be controlled.

In an example, using the depletion-mode switches for the default path can reduce system power by connecting the default path without powering the audio switch system 500.

IntelliMax Switch with Depletion-mode Switches

Many mobile electronic devices, such as mobile phones, use typical enhancement-mode load switches or discrete FETs to route or isolate power. In many examples, the default mode is "ON", and accordingly, power is be consumed in the default mode. For example, a load switch can be used to isolate power between a power source (e.g., a battery) and a system of the mobile electronic device. In typical applications, for a majority of the mobile electronic devices lifetime, the load switch is conducting and using power.

Figure 6:
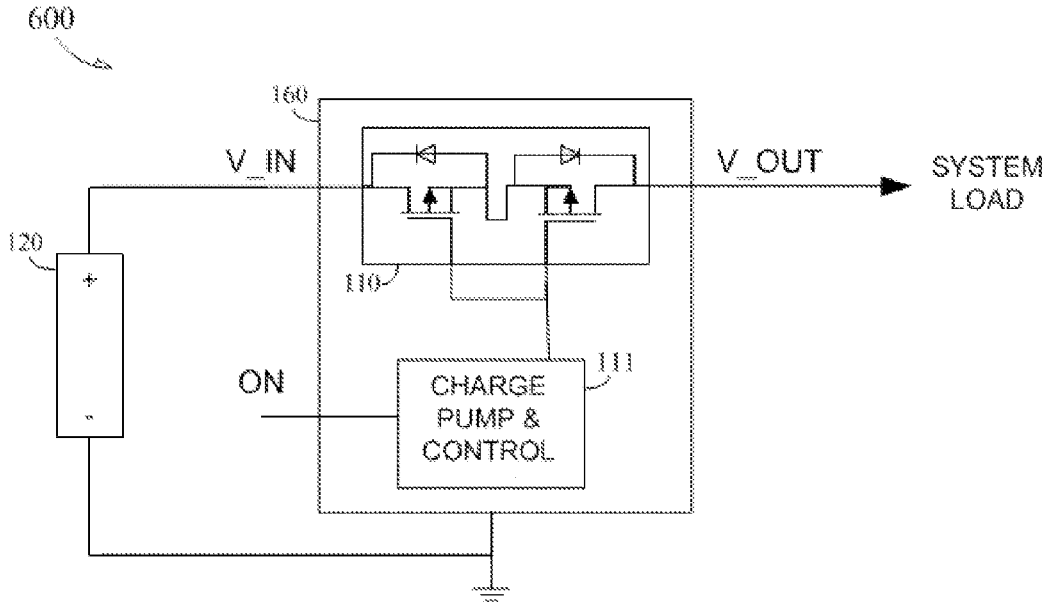
FIG. 6 illustrates generally an example of a power switch for a power path, the power switch including a depletion-mode switch configured to connect a power source to a system of a mobile electronic device without the power switch utilizing power.

FIG. 6 illustrates generally an example of a power switch system 600 including a power switch 160 and a battery 120. In an example, for a power path (e.g., a PMOS power path), the power switch 160 can include a depletion-mode switch 110 configured to connect a power source (e.g., the battery 120) to a system of a mobile electronic device without the power switch 160 utilizing power in the default low-impedance mode. Accordingly, in applications where the mobile electronic device is "ON" more than it is "OFF", the depletion-mode switch can decrease the amount of power consumed, in certain examples, increasing overall system battery life.

The power switch 600 can include a charge pump and control circuitry 111 configured to provide a gate signal to the depletion-mode switch 110 when sufficient power is applied to the power switch 150, placing the depletion-mode switch 110 in a high-impedance mode.

IntelliMax Discharge Path with Depletion-mode Switch

Many mobile electronic devices, such as mobile phones, can use load switches to isolate power and provide desired or correct power sequencing in the mobile electronic device. Typical load switches include an n-channel enhancement-mode semiconductor switch to discharge the isolated power path for the next power sequence. When the power source (e.g., a battery) is removed, the discharge path can no longer be connected because there is no power to place the enhancement-mode switch in a low-impedance mode.

Figure 7:
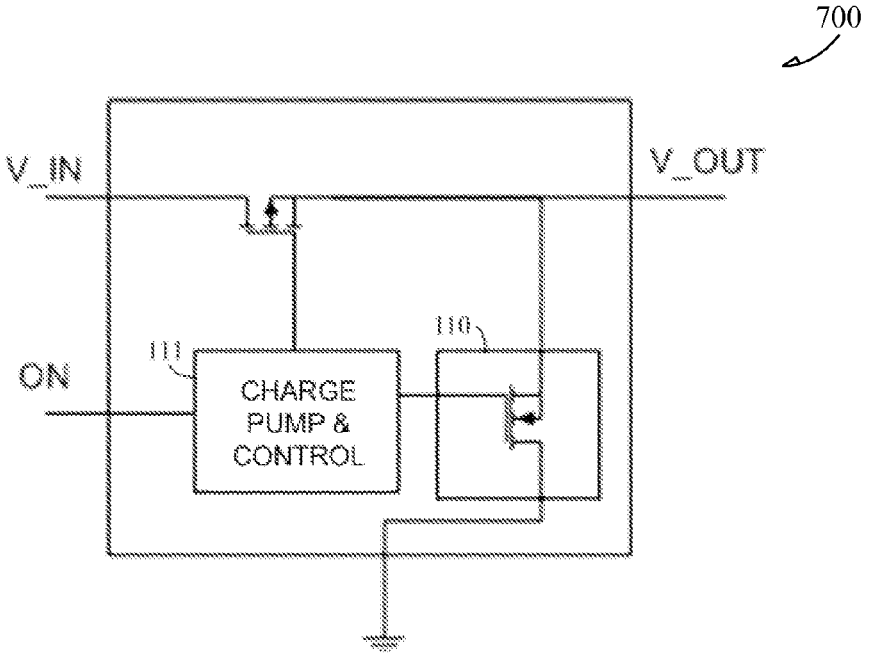
FIG. 7 illustrates generally an example load switch including a depletion-mode switch configured to provide a discharge path to ground without power to the load switch.

FIG. 7 illustrates generally an example load switch 700 (e.g., for an n-channel enhancement-mode semiconductor switch discharge path) including a depletion-mode switch 110 configured to provide a discharge path to ground without power to the load switch 700. In an example, the depletion-mode switch can allow the load switch 700 to fully discharge the power path without connection to the battery and can ensure proper power sequencing on the next power cycle.

The load switch 700 can include a charge pump and control circuitry 111 configured to provide a gate signal to the depletion-mode switch 110 when sufficient power is applied to the load switch 700, placing the depletion-mode switch 110 in a high-impedance mode.

Additional Notes

In Example 1, a system includes a depletion-mode switch configured to pass an audio signal from an input to an output in a low-impedance state when a power source is below a threshold and to isolate the input from the output in a high-impedance state when the power source is above the threshold and a noise-cancelation circuit configured to receive the audio signal from the input and to provide a modulated audio signal at the output when the power source is above the threshold.

In Example 2, Example 1 can optionally include a charge pump configured to provide a control signal to the depletion-mode switch to place the depletion-mode switch in a high-impedance state when the power source is above the threshold.

In Example 3, the power source of any one or more of Examples 1-2 is optionally a battery.

In Example 4, any one or more of Examples 1-3 optionally includes a headset, wherein the headset includes the noise-cancelation circuit and the depletion-mode switch.

In Example 5, the headset of any one or more of Examples 1-4 optionally includes a wired headset configured to be coupled to an electronic device using a physical, wired connection.

In Example 6, the depletion-mode switch of any one or more of Examples 1-5 optionally includes first and second depletion-mode switches configured to pass respective first and second stereo-audio signals from first and second audio inputs to first and second audio outputs in a low-impedance state when the power source is below the threshold.

In Example 7, the threshold of any one or more of Examples 1-6 optionally includes a minimum operating voltage of the noise-cancelation circuit.

In Example 8, the depletion-mode switch of any one or more of Examples 1-7 optionally includes a depletion mode PMOS device.

In Example 9, the noise-cancelation circuit of any one or more of Examples 1-8 is optionally coupled in parallel with the depletion-mode switch, such that, when the depletion-mode switch is configured to isolate the input from the output in the high-impedance state, the noise-cancelation circuit can provide the modulated audio signal at the output based on the audio signal received from the input.

In Example 10, a method includes passing an audio signal from an input to an output using a depletion-mode switch in a low-impedance state when a power source is below a threshold, isolating the input from the output using the depletion-mode switch in a high-impedance state when the power source is above the threshold, receiving the audio signal from the input using a noise-cancelation circuit, and providing, using the noise-cancelation circuit, a modulated audio signal at the output when the power source is above the threshold.

In Example 11, any one or more of Examples 1-10 optionally includes providing a control signal to the depletion-mode switch using a charge pump to place the depletion-mode switch in a high-impedance state when the power source is above the threshold.

In Example 12, the power source of any one or more of Examples 1-11 is optionally a battery.

In Example 13, the noise-cancelation circuit and the depletion-mode switch of any one or more of Examples 1-12 are optionally included in a headset.

In Example 14, the headset of any one or more of Examples 1-13 optionally includes a wired headset configured to be coupled to an electronic device using a physical, wired connection.

In Example 15, the passing the audio signal of any one or more of Examples 1-14 optionally includes passing respective first and second stereo-audio signals from first and second audio inputs to first and second audio outputs using first and second depletion-mode switches in a low-impedance state when the power source is below the threshold.

In Example 16, the threshold of any one or more of Examples 1-15 optionally includes a minimum operating voltage of the noise-cancelation circuit.

In Example 17, the depletion-mode switch of any one or more of Examples 1-16 optionally includes a depletion mode PMOS device.

In Example 18, a system includes an audio jack receptacle having a left speaker terminal and a right speaker terminal, a battery having a battery voltage, a left speaker, a right speaker, a first depletion-mode switch having a first terminal coupled to the left speaker terminal and a second terminal coupled to the left speaker, the first depletion-mode switch configured to pass an audio signal from the left speaker terminal to the left speaker in a low-impedance state when the battery voltage is below a threshold and to isolate the left speaker terminal from the left speaker in a high-impedance state when the battery is above the threshold, a second depletion-mode switch having a first terminal coupled to the right speaker terminal and a second terminal coupled to the right speaker, the second depletion-mode switch configured to pass an audio signal from the right speaker terminal to the right speaker in a low-impedance state when the battery voltage is below a threshold and to isolate the right speaker terminal from the right speaker in a high-impedance state when the battery is above the threshold, and a noise-cancelation circuit configured to receive the audio signal from the left speaker terminal and the right speaker terminal and to provide a modulated audio signal at the left speaker and the right speaker when the battery is above the threshold.

In Example 19, any one or more of Examples 1-18 optionally includes a charge pump configured to provide a control signal to the first and second depletion-mode switches to place the first and second depletion-mode switches in a high-impedance state when the battery is above the threshold.

In Example 20, the threshold of any one or more of Examples 1-19 optionally includes a minimum operating voltage of the noise-cancelation circuit.

In Example 21, a system or apparatus can include, or can optionally be combined with any portion or combination of any portions of any one or more of Examples 1-20 to include, means for performing any one or more of the functions of Examples 1-20, or a machine-readable medium including instructions that, when performed by a machine, cause the machine to perform any one or more of the functions of Examples 1-20.

These non-limiting examples can be combined in any permutation or combination.

The above detailed description includes references to the accompanying drawings, which form a part of the detailed description. The drawings show, by way of illustration, specific embodiments in which the invention can be practiced. These embodiments are also referred to herein as "examples." Such examples can include elements in addition to those shown or described. However, the present inventors also contemplate examples in which only those elements shown or described are provided. Moreover, the present inventors also contemplate examples using any combination or permutation of those elements shown or described (or one or more aspects thereof), either with respect to a particular example (or one or more aspects thereof), or with respect to other examples (or one or more aspects thereof) shown or described herein.

All publications, patents, and patent documents referred to in this document are incorporated by reference herein in their entirety, as though individually incorporated by reference. In the event of inconsistent usages between this document and those documents so incorporated by reference, the usage in the incorporated reference(s) should be considered supplementary to that of this document; for irreconcilable inconsistencies, the usage in this document controls.

In this document, the terms "a" or "an" are used, as is common in patent documents, to include one or more than one, independent of any other instances or usages of "at least one" or "one or more." In this document, the term "or" is used to refer to a nonexclusive or, such that "A or B" includes "A but not B," "B but not A," and "A and B," unless otherwise indicated. In this document, the terms "including" and "in which" are used as the plain-English equivalents of the respective terms "comprising" and "wherein." Also, in the following claims, the terms "including" and "comprising" are open-ended, that is, a system, device, article, or process that includes elements in addition to those listed after such a term in a claim are still deemed to fall within the scope of that claim. Moreover, in the following claims, the terms "first," "second," and "third," etc. are used merely as labels, and are not intended to impose numerical requirements on their objects.

Method examples described herein can be machine or computer-implemented at least in part. Some examples can include a computer-readable medium or machine-readable medium encoded with instructions operable to configure an electronic device to perform methods as described in the above examples. An implementation of such methods can include code, such as microcode, assembly language code, a higher-level language code, or the like. Such code can include computer readable instructions for performing various methods. The code may form portions of computer program products. Further, in an example, the code can be tangibly stored on one or more volatile, non-transitory, or non-volatile tangible computer-readable media, such as during execution or at other times. Examples of these tangible computer-readable media can include, but are not limited to, hard disks, removable magnetic disks, removable optical disks (e.g., compact disks and digital video disks), magnetic cassettes, memory cards or sticks, random access memories (RAMs), read only memories (ROMs), and the like.

The above description is intended to be illustrative, and not restrictive. For example, the above-described examples (or one or more aspects thereof) may be used in combination with each other. Other embodiments can be used, such as by one of ordinary skill in the art upon reviewing the above description. The Abstract is provided to comply with 37 C.F.R. §1.72(b), to allow the reader to quickly ascertain the nature of the technical disclosure. It is submitted with the understanding that it will not be used to interpret or limit the scope or meaning of the claims. Also, in the above Detailed Description, various features may be grouped together to streamline the disclosure. This should not be interpreted as intending that an unclaimed disclosed feature is essential to any claim. Rather, inventive subject matter may lie in less than all features of a particular disclosed embodiment. Thus, the following claims are hereby incorporated into the Detailed Description, with each claim standing on its own as a separate embodiment, and it is contemplated that such embodiments can be combined with each other in various combinations or permutations. The scope of the invention should be determined with reference to the appended claims, along with the full scope of equivalents to which such claims are entitled.

What is claimed is:

1. A system, comprising:

a depletion-mode switch configured to pass an audio signal from an input to an output in a low-impedance state when a power source is below a threshold and to isolate the input from the output in a high-impedance state when the power source is above the threshold; and a noise-cancelation circuit configured to receive the audio signal from the input and to provide a modulated audio signal at the output when the power source is above the threshold.

2. The system of claim 1, including a charge pump configured to provide a control signal to the depletion-mode switch to place the depletion-mode switch in a high-impedance state when the power source is above the threshold.

3. The system of claim 1, wherein the power source is a battery.

4. The system of claim 1, including a headset, wherein the headset includes the noise-cancelation circuit and the depletion-mode switch.

5. The system of claim 4, wherein the headset includes:

a wired headset configured to be coupled to an electronic device using a physical, wired connection;

an audio jack receptacle having a left speaker terminal and a right speaker terminal;

a battery having a battery voltage;

a left speaker; and a right speaker.

6. The system of claim 1, wherein the depletion-mode switch includes:

a first depletion-mode switch having a first terminal coupled to a left speaker terminal of an audio jack receptacle and a second terminal coupled to a left speaker, the first depletion-mode switch configured to pass an audio signal from the left speaker terminal to the left speaker in a low-impedance state when the power source is below the threshold and to isolate the left speaker terminal from the left speaker in a high-impedance state when the power source is above the threshold;

a second depletion-mode switch having a first terminal coupled to a right speaker terminal of the audio jack receptacle and a second terminal coupled to a right speaker, the second depletion-mode switch configured to pass an audio signal from the right speaker terminal to the right speaker in a low-impedance state when the power source is below the threshold and to isolate the right speaker terminal from the right speaker in a high-impedance state when the power source is above the threshold, wherein the noise-cancelation circuit is configured to receive the audio signal from the left speaker terminal and the right speaker terminal and to provide the modulated audio signal to the left speaker and the right speaker when the battery is above the threshold.

7. The system of claim 1, wherein the threshold includes a minimum operating voltage of the noise-cancelation circuit.

8. The system of claim 1, wherein the depletion-mode switch includes a depletion mode PMOS device.

9. The system of claim 1, wherein the noise-cancelation circuit is coupled in parallel with the depletion-mode switch, such that, when the depletion-mode switch is configured to isolate the input from the output in the high-impedance state, the noise-cancelation circuit can provide the modulated audio signal at the output based on the audio signal received from the input.

10. A method, comprising:

passing an audio signal from an input to an output using a depletion-mode switch in a low-impedance state when a power source is below a threshold;

isolating the input from the output using the depletion-mode switch in a high-impedance state when the power source is above the threshold;

receiving the audio signal from the input using a noise-cancelation circuit; and providing, using the noise-cancelation circuit, a modulated audio signal at the output when the power source is above the threshold.

11. The method of claim 10, including:

providing a control signal to the depletion-mode switch using a charge pump to place the depletion-mode switch in a high-impedance state when the power source is above the threshold.

12. The method of claim 10, wherein the power source is a battery.

13. The method of claim 10, wherein the noise-cancelation circuit and the depletion-mode switch are included in a headset.

14. The method of claim 13, wherein the headset includes a wired headset configured to be coupled to an electronic device using a physical, wired connection.

15. The method of claim 10, wherein passing the audio signal includes passing respective first and second stereo-audio signals from first and second audio inputs to first and second audio outputs using first and second depletion-mode switches in a low-impedance state when the power source is below the threshold.

16. The method of claim 10, wherein the threshold includes a minimum operating voltage of the noise-cancelation circuit.

17. The method of claim 10, wherein the depletion-mode switch includes a depletion mode PMOS device.

18. A noise-cancelation system, comprising:

an audio jack receptacle having a left speaker terminal and a right speaker terminal;

a battery having a battery voltage;

a left speaker;

a right speaker;

a first depletion-mode switch having a first terminal coupled to the left speaker terminal and a second terminal coupled to the left speaker, the first depletion-mode switch configured to pass an audio signal from the left speaker terminal to the left speaker in a low-impedance state when the battery voltage is below a threshold and to isolate the left speaker terminal from the left speaker in a high-impedance state when the battery voltage is above the threshold;

a second depletion-mode switch having a first terminal coupled to the right speaker terminal and a second terminal coupled to the right speaker, the second depletion-mode switch configured to pass an audio signal from the right speaker terminal to the right speaker in a low-impedance state when the battery voltage is below a threshold and to isolate the right speaker terminal from the right speaker in a high-impedance state when the battery voltage is above the threshold; and a noise-cancelation circuit configured to receive the audio signal from the left speaker terminal and the right speaker terminal and to provide a modulated audio signal at the left speaker and the right speaker when the battery is above the threshold.

19. The system of claim 18, including a charge pump configured to provide a control signal to the first and second depletion-mode switches to place the first and second depletion-mode switches in a high-impedance state when the battery is above the threshold.

20. The system of claim 18, wherein the threshold includes a minimum operating voltage of the noise-cancelation circuit.

* * * * *